United States Patent [19]

Odle et al.

[11] 4,085,318

[45] Apr. 18, 1978

[54] LUMINAIRE AND LUMINAIRE REFLECTOR FOR USE IN AN OFF-THE ROADWAY LIGHTING ARRANGEMENT

[75] Inventors: Herbert Arnold Odle, Newark, Ohio; Donald Edward Ruehl, Belle Mead, N.J.; Jan Shadwick; Daryl Dean Sullivan, both of Newark, Ohio; Dale Eugene Welty, Christiansburg, Va.

[73] Assignee: Johns-Manville Corporation, Denver, Colo.

[21] Appl. No.: 801,495

[22] Filed: Apr. 11, 1977

Related U.S. Application Data

[63] Continuation of Ser. No. 462,838, Apr. 22, 1974, abandoned.

[51] Int. Cl.[2] ..... F21S 1/10

[52] U.S. Cl. ..... 362/217

[58] Field of Search ..... 240/25, 9 R, 3, 41.35 F

[56] References Cited

U.S. PATENT DOCUMENTS

| | | | |
|---|---|---|---|
| 2,229,034 | 1/1941 | Bergmans | 240/25 |
| 2,486,558 | 11/1949 | Franck | 240/25 |
| 2,647,202 | 7/1953 | Elmer | 240/25 |
| 2,886,698 | 5/1959 | Dorman | 240/25 |
| 3,284,625 | 11/1966 | Barnes | 240/25 |
| 3,350,556 | 10/1967 | Franck | 240/25 |

*Primary Examiner*—Monroe H. Hayes

*Attorney, Agent, or Firm*—Robert M. Krone; Joseph J. Kelly; Stephen C. Shear

[57] ABSTRACT

An arrangement for lighting a given straight section of a roadway having spaced-apart parallel curbs is disclosed herein and includes a luminaire positioned a substantial distance to one side of and above the roadway curbs. The luminaire includes a reflector, light source and a refractor which cooperate to effectively and efficiently light the given roadway section while, at the same time, minimizing the amount of light which spills onto opposite sides of the roadway curbs.

14 Claims, 12 Drawing Figures

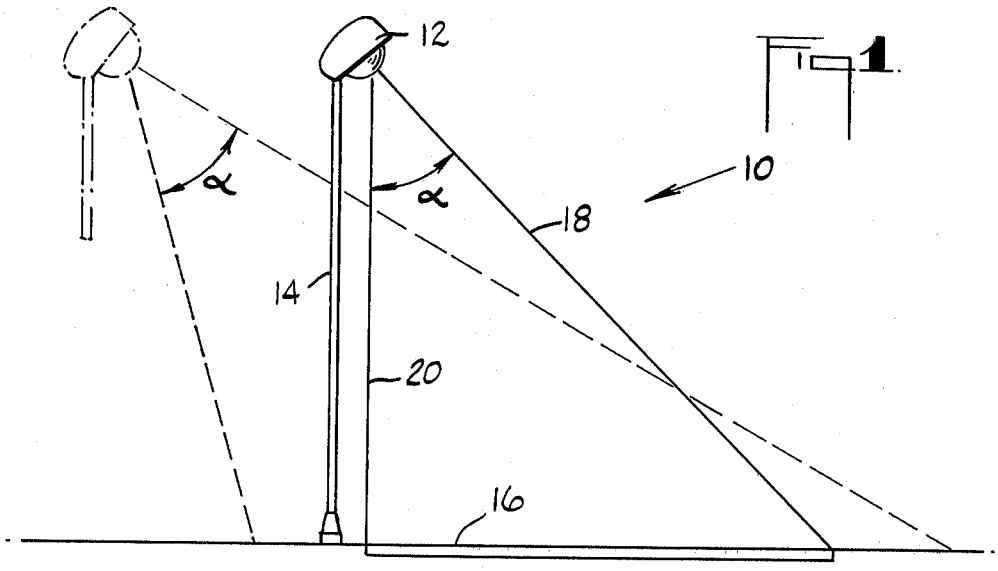
FIG. 1
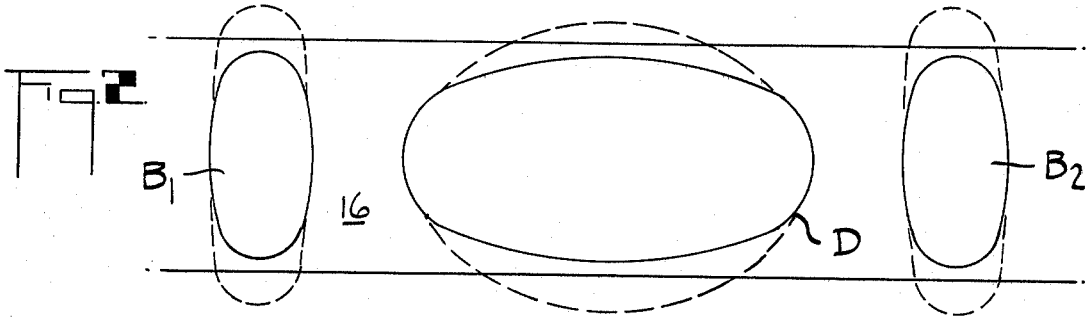
FIG. 2
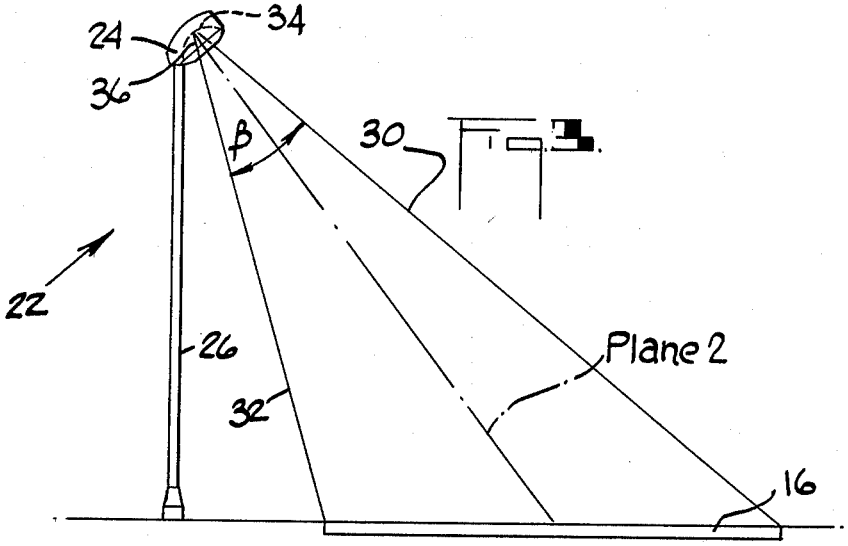
FIG. 3
FIG. 4
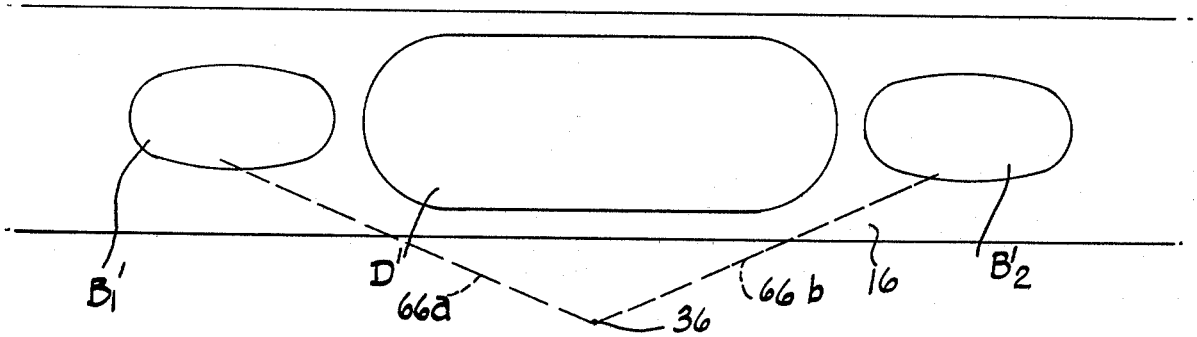

LUMINAIRE AND LUMINAIRE REFLECTOR FOR USE IN AN OFF-THE ROADWAY LIGHTING ARRANGEMENT

This is a continuation of application Ser. No. 462,838, filed Apr. 22, 1974 now abandoned.

BACKGROUND OF THE INVENTION

The present invention relates generally to luminaires and more particularly to a specific luminaire, a specific luminaire reflector and a specific luminaire refractor especially suitable for lighting a given straight roadway section from a point a substantial distance to one side of and above the roadway.

Today, most roadways and particularly expressways such as interstate highways that are lighted are done so with conventional luminaires supported on poles mounted at or in close proximity to one curb of the roadway. The poles positioned in this manner produce an obvious and definite collision hazard condition to oncoming vehicles, especially on crowded and fast-moving modern day expressways. As will be seen below, there have been several attempts to eliminate or minimize this hazardous condition. However, for various reasons, these attempts have not been completely successful.

One suggested solution to minimize the aforedescribed hazardous condition has been to provide the luminaire pole with a frangible base so that when the base is hit by an oncoming vehicle it breaks off, presumably without causing much damage to the vehicle or bodily harm to the occupant or occupants. This suggested solution has several obvious disadvantages. In the first place, the maintenance required in replacing these collided poles and the supported luminaires as a result of the collision would be extremely high and, in fact, economically impractical. In the second place, there would be some and possibly a large amount of property damage to the vehicle as a result of the collision. In the third place, the falling pole quite possibly could strike another vehicle on the roadway or the driver of the colliding vehicle could lose even greater control of his vehicle as a result of the collision.

Another suggested solution which would eliminate completely the aforedescribed hazardous condition has been to mount the poles on a solid concrete median such that the poles are located above the point at which they would interfere with oncoming vehicles. This would, of course, eliminate any possibility of collision. However, to provide medians, which do not already exist or which are not otherwise suitable, would be economically impractical.

A further suggested solution has been to place the luminaire poles a substantial distance to one side of the roadway, for example 30 feet, and to mount their associated luminaires directly above the roadway by utilizing extremely long mast arms extending from the poles. This, too, is economically impractical, mainly because the mast arms to support the luminaires would have to be extremely strong and very expensive. In this regard, there have been suggestions to eliminate or substantially shorten the mast arms and position the luminaires a substantial distance to one side of the roadway, that is, at or at least in close proximity to the remotely positioned poles. This has not been found to be a satisfactory solution because conventional luminaires are designed to be mounted at the edge of the roadway and do not efficiently or effectively light the roadway from such remote off-the-roadway points.

As will be seen hereinafter, the present invention eliminates the aforedescribed hazardous condition by positioning the luminaire poles a substantial distance to one side of the roadway as previously suggested. However, unlike the last-mentioned suggested solution, the present invention includes a specifically designed luminaire and, in fact, a specifically designed reflector and refractor especially suitable for off-the-roadway use without appreciably compromising the quantity or quality of light placed on the roadway.

BRIEF SUMMARY OF THE INVENTION

An object of the present invention is to provide an efficient and effective arrangement for lighting a given section of a roadway from a point which is above and a substantial distance to one side of the roadway.

Another object of the present invention is to provide a luminaire which effectively and efficiently lights a given section of a roadway from a point which is above and a substantial distance to one side of the roadway.

A further object of the present invention is to provide a reflector which is especially suitable for use as a component of the last-mentioned luminaire.

The aforestated objects as well as other objects and features of the present invention are achieved by the utilization of a luminaire which includes a reflector having first and second side-by-side light reflective surfaces, each of which is defined by a segment of a paraboloid of revolution. These light reflective surfaces, which lie on opposite sides of a given first plane, have a common focal point located on the intersecting line of this plane and a second plane normal to and intersecting this plane and respective first and second parabolic axes, both lying on the second plane. The first axis extends forwardly of and past the second light reflective surface at an acute angle with the first plane and the second axis extends forwardly of and past the first light reflective surface at the same acute angle with the first plane. A linear light source is provided and, in accordance with the present invention, is positioned to extend substantially along the intersection of the first two planes and through the common focal point.

With the luminaire constructed in this manner, it is positioned above and a substantial distance to one side of the roadway. In addition, the luminaire is tilted towards the roadway such that the second plane, that is, the plane including the parabolic axes intersects the roadway in a direction parallel to the roadway curbs. In this manner, the two light reflective surfaces cooperating with the light source direct two crossing beams of light to opposite end segments of the roadway section to be lighted in an effective and efficient fashion. The intermediate segment of the roadway section is lighted by direct light and some reflected light.

BRIEF DESCRIPTION OF THE DRAWINGS

FIG. 1 is a schematic illustration, in elevational view, of a conventional "on-the-roadway" lighting arrangement utilizing a conventional luminaire positioned above and in close proximity to one side of the roadway.

FIG. 2 is a schematic illustration, in plan view, showing how segments of the roadway section illustrated in FIG. 1 are lighted by the luminaire shown in FIG. 1.

FIG. 3 is a schematic illustration, in side elevational view, of an "off-the-roadway" lighting arrangement utilizing a luminaire which is constructed in accordance with the present invention and which is positioned above and a substantial distance to one side of the roadway.

FIG. 4 is a schematic illustration, in plan view, showing the manner in which the roadway section is lighted by the luminaire illustrated in FIG. 3.

DETAILED DESCRIPTION AND PREFERRED EMBODIMENTS

Figure 5:
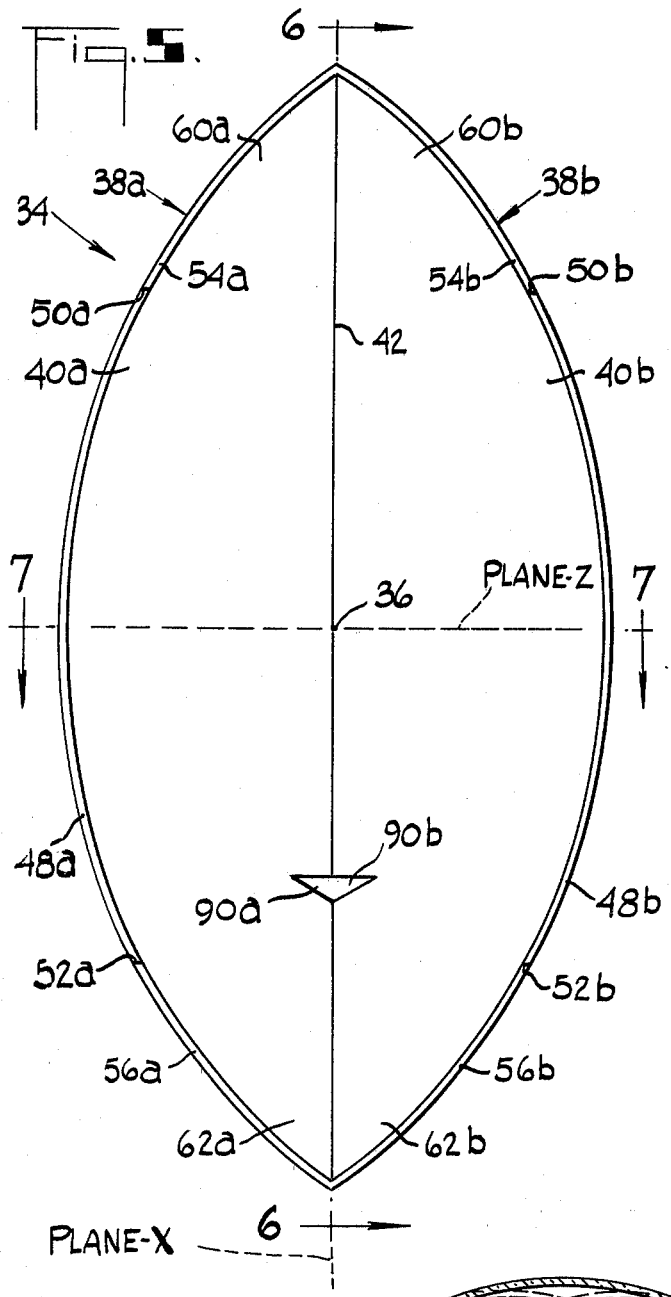
FIG. 5 is a frontal view of a luminaire reflector and linear light source, the light source being positioned in accordance with the present invention and the reflector being constructed in accordance with the present invention.

Turning now to the drawings, wherein like components are designated by like reference numerals throughout the various figures, attention is firstly and briefly directed to a conventional "on-the-roadway" lighting arrangement 10 which is shown schematically in FIG. 1. As illustrated in this figure, arrangement 10 includes a luminaire 12 which is supported by, for example, a pole 14 and which is positioned a substantial distance, for example, 30 feet to 50 feet, directly above the near curb of a roadway 16.

Luminaire 12 is one which is well known in the art and has been designed to effectively and efficiently light a lengthwise section of roadway 16 from its on-the-roadway position shown in FIG. 1, with little if any light passing outside the far curb or inside the near curb. To accomplish this, the luminaire produces what may be referred to as a "wedge" of light indicated by planes 18 and 20 which extend presumably from the light center of the luminaire and intersect the far and near curbs of roadway 16, respectively. This wedge defines a wedge angle $\alpha$, the magnitude of which is dependent upon the relative positions of the luminaire and roadway curbs and designed into the luminaire to provide the configuration shown in FIG. 1.

FIG. 2 illustrates schematically how a lengthwise section of roadway 16 is lighted by arrangement 10. For purposes of simplicity, only light segments from three predominant beams of light provided by luminaire 12 for lighting the roadway section will be shown. In this regard, the conventional luminaire of the prior art, i.e., for example luminaire 12, depends upon a reflector to lay down beams of light approximately perpendicular to the curb lines of the roadway. Two such beams of light produce light segments B1 and B2, which are indicated in FIG. 2. The luminaire's refractor is then called upon to widen these beams both laterally and, more importantly, lengthwise of the street so as to provide, along with direct and some reflected light indicated by light segment D, a smooth beam pattern along the roadway section to be lighted and just within the curbs of this section.

For purposes of illustration, luminaire 12 will now be positioned a substantial distance to one side of the roadway but at the same height, as indicated by dotted lines in FIG. 1. With the luminaire tilted towards the street, notice that the wedge defined by angle $\alpha$ intersects the roadway in a substantially overlapping fashion, that is, the plane 18 (now indicated by dotted lines) intersects the ground a substantial distance beyond the far curb and the plane 20 (also now indicated by dotted lines) intersects the ground well before the near curb. With the luminaire positioned in this manner, the light segments B1, B2 and D extend a substantial distance beyond the roadway curbs, as indicated by dotted lines in FIG. 2. To eliminate this, the luminaire could, of course, be lowered so that the wedge of light just intersects the roadway. However, this would substantially reduce the lengthwise amount of roadway section which could be lighted and hence would require substantially more luminaires.

Turning now to FIG. 3, attention is now directed to an "off-the-roadway" lighting arrangement 22 including a luminaire 24 which is constructed in accordance with the present invention. Luminaire 24 is mounted by suitable means (not shown) to a pole 26 such that the luminaire is preferably between 30 feet and 50 feet above roadway 16 and preferably between 30 and 50 feet to one side of the roadway's near curb.

As will be seen hereinafter, luminaire 24 is angled or tilted towards the roadway, preferably at a particular angle relative to the roadway to effectively and efficiently light up a given roadway segment. In this regard, it should be noted that luminaire 24, like luminaire 12, produces a wedge of light directed towards the roadway and intersecting opposite curbs of the roadway, as indicated by planes 30 and 32. However, it should be noted that because of the relative position of the roadway and luminaire, the angle $\beta$ defining this wedge of light is substantially smaller than the previously discussed angle $\alpha$ defining the wedge produced by luminaire 12. In fact, depending upon the parameters, angle $\beta$ could be as small as one-third that of angle $\alpha$. One object of an effective and efficient roadway luminaire and an object of the present invention is to put as much light as possible in this substantially smaller wedge and to spread the light as uniformly as possible lengthwise of the roadway in a somewhat rectangular fashion to produce uniform roadway illumination.

FIG. 4, like previously described in FIG. 2, illustrates a section of roadway 16 in plan view and schematically shows two lighted segments B1' and B2'. As will be seen hereinafter, these lighted segments are produced by crossing beams of reflected light from luminaire 24 and are located near the ends of the roadway section to be lighted. As will also be seen hereinafter, these segments B1' and B2' are widened by means of a refractor and light indicated by the segment D' is filled in between these segments by means of reflected and direct light also acted upon by the refractor to uniformly light the roadway segment.

It should be noted from FIG. 4 that the segments B1′ and B2′ are similar in shape and length to the previously discussed segments B1 and B2 shown in FIG. 2. However, in accordance with one feature of the present invention, the segments B1′ and B2′ extend lengthwise of the roadway, whereas the previously discussed segments B1 and B2 extend normal to the roadway. This distinction is very important because the minimum length of these segments on the roadway is at least in part determined by the length of the light source used with the luminaire. Once the luminaire, either luminaire 12 or 24, is located in a fixed position relative to the roadway, the minimum length of segments B1, B2, B1′ or B2′ is fixed and dependent upon the length of the light source used. While the length of these segments can be increased by means of a reflector or refractor, they cannot readily be decreased without decreasing the length of the light source. Therefore, the segments B1 and B2 indicated by dotted lines in FIG. 2 and produced by luminaire 12 positioned away from roadway 16 cannot be readily decreased in length to just meet the curbs of the roadway other than by reducing the length of the light source. While the length of the source could, of course, be reduced, this might substantially reduce the amount of light available by the luminaire or it might require heavier loading of the source to maintain the available light unchanged.

In accordance with one feature of the present invention, it does not matter that the segments B1′ and B2′ increase in length as the luminaire is moved back from roadway 16 because these segments, as stated above, extend lengthwise of the roadway. Hence, the luminaire 24 can be positioned a substantial distance off the roadway without the fear of spilling light over the far curb or in an area inside the near curb. The segments B1′ and B2′ can, of course, be lengthened and widened to fill greater areas of the roadway. The manner in which this is accomplished as well as the manner in which segments B1′ and B2′ are originally produced will be described below.

Figure 6:
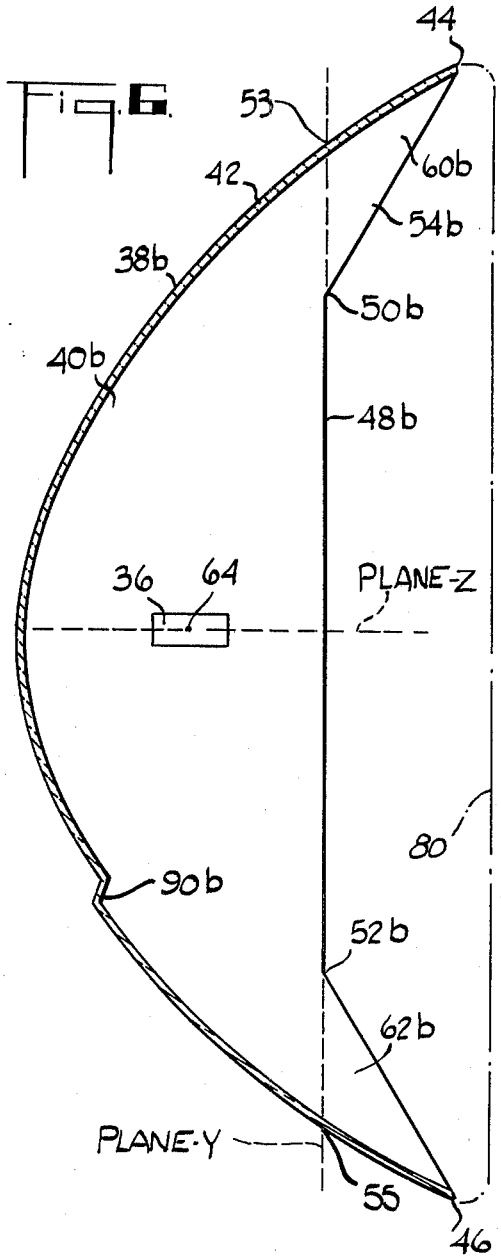
FIG. 6 is a vertical cross-sectional view of the reflector of FIG. 5 taken generally along the line 6—6 in FIG. 5.
Figure 7:
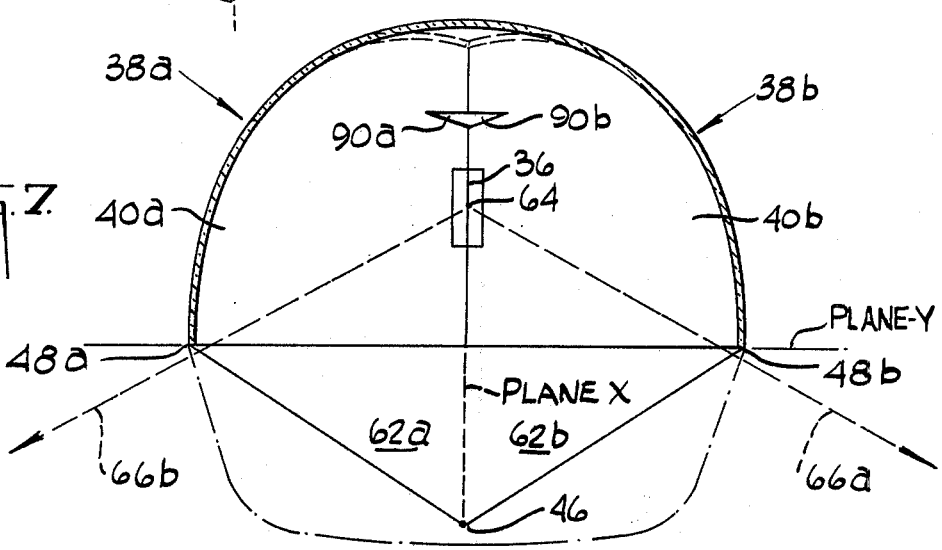
FIG. 7 is a horizontal cross-sectional view of the reflector and light source of FIG. 6, generally taken along line 7—7 in FIG. 5.

Turning now to FIGS. 5–7, attention is directed to a reflector 34 which is constructed in accordance with the present invention, which comprises part of previously discussed luminaire 24 and which together with a linear light source 36 are primarily responsible for the production of light segments B1′ and B2′. As best seen in FIG. 5, reflector 34 is comprised of two reflector sections 38*a* and 38*b* which, in configuration, are mirror images of one another and which lie on opposite sides of a given plane X. Reflector sections 38*a* and 38*b*, which have been shown exaggerated in thickness for purposes of clarity, respectively include light reflective surfaces, for example polished aluminum, 40*a* and 40*b*, each of which comprises a segment of a paraboloid of revolution. As will be seen hereinafter, these surfaces are responsible for producing crossing beams of light resulting in previously described light segments B1′ and B2′ respectively.

Light reflective surfaces 40*a* and 40*b* include a common inner surface edge 42 which lies in plane X and which extends from a top end 44 to a bottom end 46 in a parabolic fashion, as best illustrated in FIG. 6. As noted in this latter figure, both the top end 44 and bottom end 46, which define the top and bottom of reflector 34, extend equal distances forwardly of a second given plane Y normal to and intersecting plane X. Surfaces 40*a* and 40*b* also include respective outer surface edges 48*a* and 48*b* which lie on plane Y (see FIG. 7) and which curve in a parabolic fashion outwardly from one another (see FIG. 5). It should be noted that these outer edge surfaces do not extend in a continuous fashion to the top and bottom ends 44 and 46 of the reflector but rather stop abruptly at upper points 50*a* and 50*b* below and inside end 44 and at lower points 52*a* and 52*b* above and inside end 46. It should also be noted, however, that plane Y does intersect the surfaces 40*a* and 40*b* above points 50*a* and 50*b* and below points 52*a* and 52*b* providing identical parabolic continuations of edges 48*a* and 48*b* along surfaces 40*a* and 40*b* all the way to common inner edge 42 in plane Y, as indicated by the points 53 and 55 in FIG. 6. This provides the additional reflective surface area above points 50*a*, 50*b* and below points 52*a*, 52*b* behind and extending to plane Y. This additional reflective surface area is not believed to be found in reflectors of even remotely similar design.

From the upper and lower surface edge 48*a*, that is, from points 50*a* and 52*a*, the outer surface edge of surface 40*a* extends outwardly and forwardly of plane Y in a continuous fashion to the end points 44 and 46 of common inner surface edge 42. These upper and lower outer surface edges may be respectively designated by the reference numerals 54*a* and 56*a*. Reflective surface 40*b* includes similar upper and lower outer surface edges 54*b* and 56*b* which respectively extend outwardly from points 50*b* and 52*b* to ends 44 and 46. It should be noted from FIG. 5 that the surface edges 54*a* and 56*a* are parabolically curved in the same manner as outer surface edge 48*a* and the outer surface edges 54*b* and 56*b* are parabolically curved in the same manner as outer edge 48*b*.

With some slight exceptions to be discussed hereinafter, light reflective surface 40*a* extends to and substantially entirely between inner surface edge 42 and outer surface edges 48*a*, 54*a* and 56*a*. In the same manner, with some slight exceptions, the light reflective surface 40*b* extends to and substantially entirely between inner surface edge 42 and outer surface edges 48*b*, 54*b* and 56*b*. While most of the surface area of each of these surfaces is located rearwardly of plane Y, as best seen in FIGS. 6 and 7, each surface 40*a* and 40*b* respectively include a substantial surface segment 60*a*, 60*b* which lies above points 50*a* and 50*b* and forwardly of plane Y and substantial surface segments 62*a*, 62*b* which lie below points 52*a* and 52*b* and forwardly of plane Y.

Figure 8:
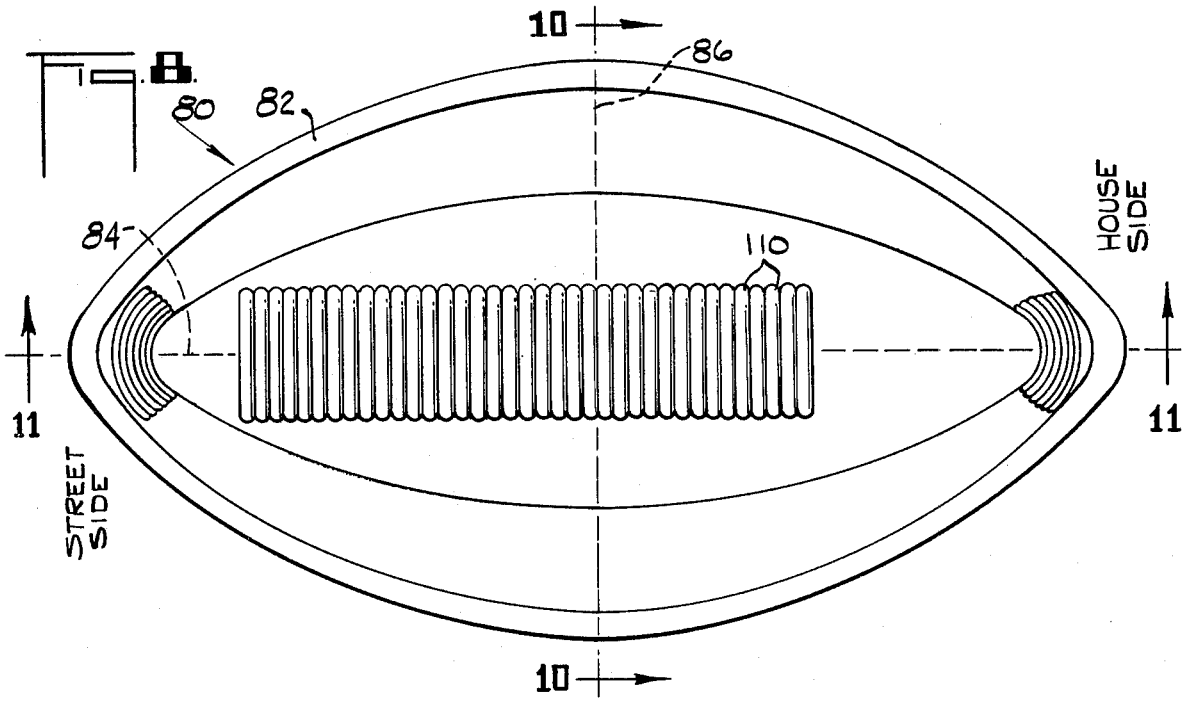
FIG. 8 is a front elevational view of a luminaire refractor which is constructed in accordance with the present invention and which cooperates with the reflector and light source illustrated in FIGS. 5–7 in comprising the luminaire illustrated in FIG. 3.

As stated above and as illustrated, both light reflective surfaces 40*a* and 40*b* include a common inner surface edge 42. However, for obvious practical reasons, it is desirable to construct the two reflector sections 38*a* and 38*b* so that they join one another at what is commonly referred to as a "baby bottom," as illustrated in FIG. 8 by dotted lines. In actual practice, this baby bottom replaces the parabolic characteristics of surfaces 40*a* and 40*b* along the common surface edge 42 with a non-parabolic surface. However, the amount of light impinging on the non-parabolic surface at the baby bottom is extremely small and for purposes of the present invention can be ignored. Hence, in an absolute sense the parabolic light reflective surfaces 40*a* and 40*b* do not actually extend to common edge 42 when the reflector sections are joined by a baby bottom. However, because as just stated, the loss of parabolic characteristics due to the baby bottom is slight, it will be assumed that the parabolic characteristics of the surfaces 40*a* and 40*b* continue to edge 42 whether or not a slight baby bottom is used to join the reflector sections. In addition to the practical reasons for having a baby bottom, there are functional advantages derived from joining the reflector sections together. More specifically, by using a baby bottom, the light source 36 sweeps across the joinder (common edge 42) of the two reflector sections with minimal dwelling at the joinder. This, in turn, eliminates the production of an excessive amount of light reflected from the joinder along nadir.

As best seen in FIGS. 6 and 7, light reflective surfaces 40*a* and 40*b* have a common focal point 64 which lies on a third given plane Z (FIG. 6) intersecting and normal to planes X and Y. The focal point is preferably located rearwardly of plane Y (FIG. 7) and on the intersection of planes X and Z. The parabolic axis 66*a* of surface 40*a* and the parabolic axis 66*b* of surface 40*b* also lie on plane Z. As illustrated in FIG. 7, axis 66*a* extends from focal point 64 forwardly of and past the outer surface edge 48*b* of surface 40*b* at an acute angle with the intersection of planes X and Z. For reasons to become apparent below, this angle is preferably between 55° and 65° and in an actual working embodiment is approximately 60° with respect to nadir. In a similar fashion, the axis 66*b* extends from focal points 64 forwardly of and past outer surface edge 48*a* of surface 40*a* at approximately the same acute angle with the intersections of planes X and Z. With luminaire 24 in its preferred operating position to be discussed below, the axes 66*a* and 66*b* are preferably between 60° and 75° from nadir.

As stated above, luminaire 24 includes a linear light source 64. This light source is preferably a mercury lamp but may also be, for example, a high-pressure sodium source, metal halide source or other such suitable linear source. The linear source has its "light center" preferably at focal point 64 and extends in plane Z along the intersection of this plane and plane X, i.e., normal to plane Y. Actually, as will be discussed, the source is preferably tilted slightly (about 5°) from this position. The reason for the particular location of the light source will be discussed hereinafter. The light source is supported in this position by suitable means (not shown). In this regard, a slight amount of surface 40*a* and a slight amount of surface 40*b* directly behind the source would more than likely be eliminated to provide this suitable support means.

With reflector 34 constructed in the aforedescribed manner and with light source 36 positioned in the aforedescribed manner, attention is now redirected to FIGS. 3 and 4 for a discussion of how the components cooperate to produce the aforedescribed light segments B1′ and B2′. As illustrated in FIG. 3, the reflector, actually the entire luminaire 24, is tilted towards roadway 16 such that plane Z, that is, the plane including source 36 and parabolic axes 66*a*, 66*b* intersects the roadway between and parallel to the roadway curbs. Hence, the light source is aimed towards the intersection of plane Z and the roadway and axes 66*a* and 66*b* extend, in a crossed fashion, outwardly and downwardly (in plane Z) towards opposite end segments of the roadway section. With the reflector tilted in this manner and with the light source positioned in this manner, light from the source is reflected off of light reflective surface 40*a* forming a beam parallel to axis 66*a* laying light segment B1′ on the roadway, as shown in FIG. 4. In a similar manner, light from the source is reflected by light reflective surface 40*b* forming a beam parallel to axis 66*b* for laying down light segment B2′ on the roadway.

As stated directly above, segments B1′ and B2′ are a result of beams of reflected light from light reflective surfaces 40*a* and 40*b*. The amount of light reflected depends upon the amount of surface area made available by these surfaces. Worded in another way, the amount of light reflected depends upon the solid angle of light intercepted by the reflecting surfaces. In any event, by increasing the available surface area to include previously described surface segments 60*a*, 60*b*, 62*a* and 62*b*, i.e., those parabolic surface segments located forwardly of plane Y, the amount of light reflected from surfaces 40*a* and 40*b* is increased. This increase is substantially greater than the proportionate increase in available light reflective surface area. In addition, the two reflector sections 38*a* and 38*b* preferably respectively include small light reflective surfaces 90*a* and 90*b* (FIG. 5) which are recessed (FIG. 6) with respect to surfaces 40*a* and 40*b*. These recessed surfaces lie on opposite sides of and adjoin common inner surface edge 42 and aid in preventing some of the reflected light from spilling inside the near roadway curb.

Segments B1′ and B2′ are shown in FIG. 4 centered with respect to the curbs of roadway 16, which is preferable. The segments are centered not necessarily because plane Z (the aiming plane) intersects the roadway exactly between the curbs, but because plane Z is the bisector of those planes extending from the curbs to the common focal point, i.e., planes 30 and 32. In fact, in most cases plane Z will not intersect the roadway exactly between the two curbs. As also shown in FIG. 4 and as stated hereinabove, segments B1′ and B2′ extend in a direction parallel to the roadway curbs, that is, lengthwise of the roadway, as opposed to extending perpendicular or across the roadway. This is a direct result of the positioning of light source 36. More specifically, because the linear light source extends parallel or approximately parallel with aiming plane Z and approximately perpendicular to plane Y, the light patterns B1′ and B2′ are laid down on the roadway as shown. If the linear light source were positioned in the typical manner, that is, perpendicular to aiming plane Z and parallel to plane Y as is, for example, the case with typical "on-the-roadway" luminaires such as previously described luminaire 12, the patterns B1′ and B2′ would extend perpendicular to the roadway curbs, i.e., just like patterns B1 and B2. In fact, it has been found that as the light source 36 is tilted from a position parallel to plane Y to a position perpendicular to plane Y the patterns B1′ and B2′ tilt from a position normal to the roadway curbs to the position shown, that is, a position parallel to the roadway curbs. In this regard, the light reflective surfaces 40*a* and 40*b* cannot, in actual practice, be made as perfect segments of a paraboloid of revolution. Hence, to obtain light segments B1′ and B2′ parallel to the roadway curbs, it may be necessary to tilt the light source slightly with respect to aiming plane Z, for example about 5°. In any event, the source would be approximately within this plane.

FIG. 4 also shows a light pattern D′ on roadway section 16 between the patterns B1′ and B2′. This intermediate light pattern results predominantly from direct light from luminaire 24 but includes some reflected light from the aforedescribed baby bottom when the latter is used to join the two light reflector sections 38*a* and 38*b*. This light is refracted in a manner to be disclosed hereinafter. Light patterns B1′, B2′ and D′ have been illustrated diagramatically. They would not, of course, be as distinct as the way in which they have been illustrated but, in any event, would take the basic shape shown in FIG. 4.

In order to smooth out and merge the light patterns B1′, B2′ and D′ to provide a substantially uniform light pattern on the roadway section 16, luminaire 24 includes a refractor 80 which is shown by dotted lines in FIGS. 6 and 7 and which is shown in detail in FIGS. 8–11. The particular prisms, flutes or other such refractive means to spread the light patterns B1′, B2′ and particularly to provide D′ will be discussed directly below.

Figure 9:
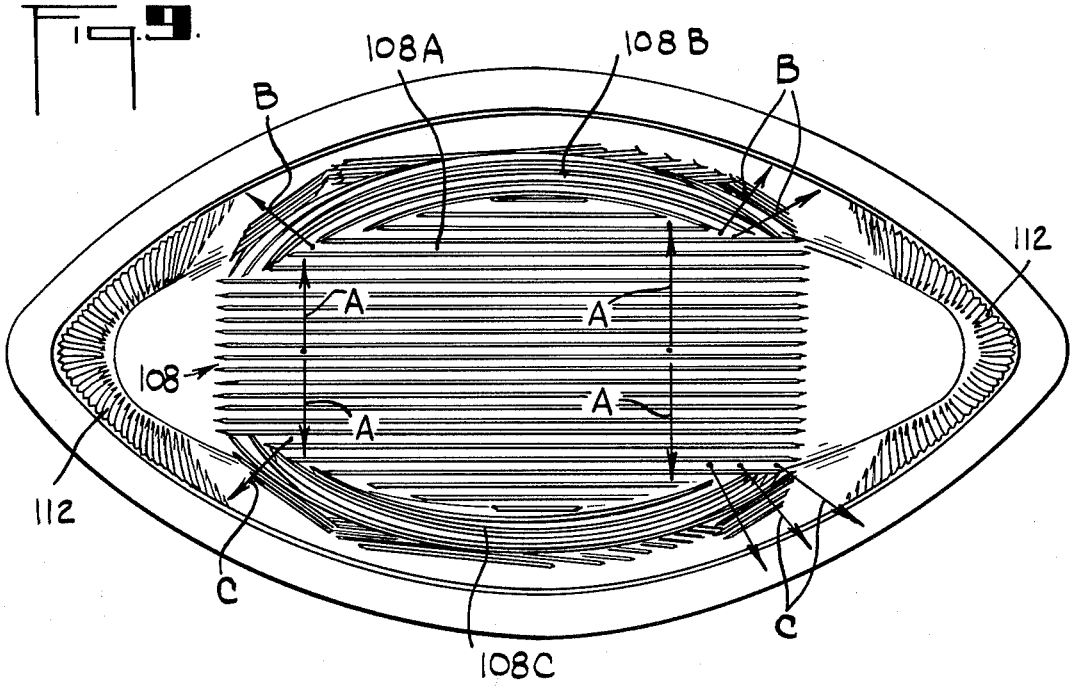
FIG. 9 is a rear elevational view of the refractor of FIG. 8.
Figure 10:
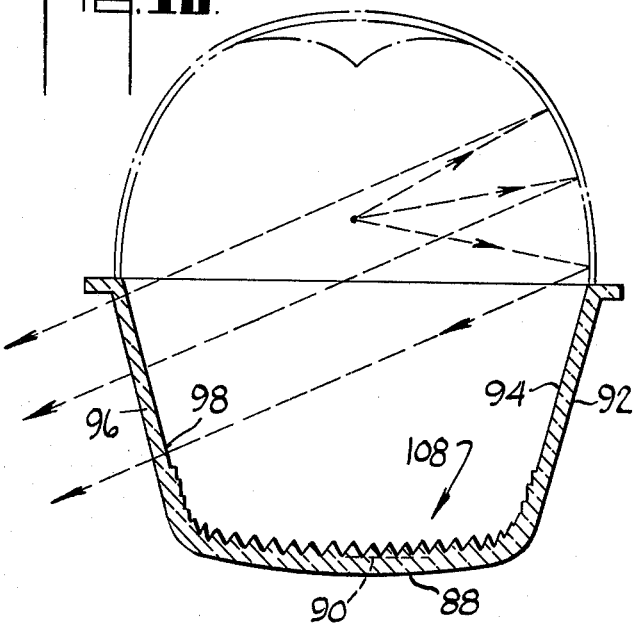
FIG. 10 is a sectional view of the refractor taken generally along line 10—10 in FIG. 8.
Figure 11:
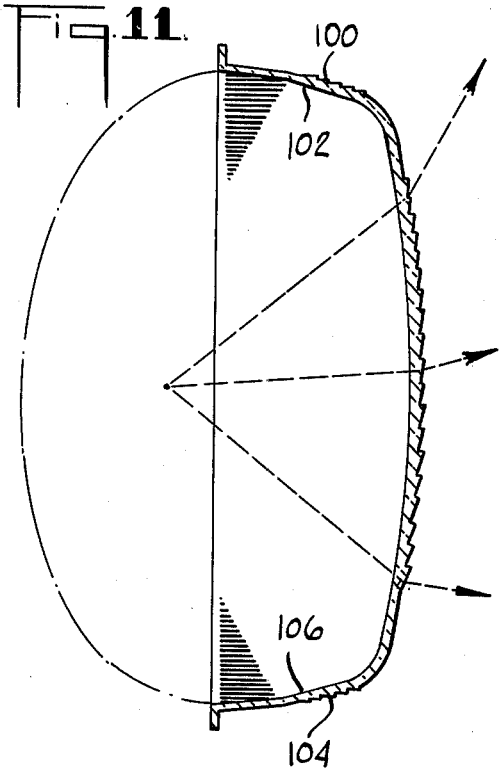
FIG. 11 is a sectional view of the refractor taken generally along line 11—11 in FIG. 8.

Turning to FIGS. 8–11, attention is directed specifically to refractor 80. As illustrated best in FIG. 8, the refractor, which is preferably constructed of glass, is somewhat oval or oblong in shape including a similarly shaped flange 82. The refractor is connected with the housing of luminaire 24 by suitable means (not shown) and fits directly over reflector 34 as best seen in FIGS. 6, 7, 9 and 10. When in a tilted operating position, the major axis of the refractor, indicated by dotted line 84, lies in plane X of reflector 34, i.e., normal to the roadway and the minor axis, indicated by dotted line 86 lies on plane Z of the reflector, i.e., parallel with the roadway. In addition, the top of the refractor, as viewed in FIG. 8, is the street end thereof and the bottom end is the house end thereof, as indicated in FIGS. 8 and 11.

Refractor 80 is bowl-shaped and includes external and internal bottom surfaces 88 and 90 which turn upwardly and respectively merge with external and internal side surfaces 92, 94 and 96, 98. These side surfaces respectively merge with top (street end) external and internal surfaces 100 and 102 and bottom (house end) external and internal surfaces 104 and 106.

As illustrated best in FIGS. 9 and 10, an arrangement 108 of prisms is located along and in bottom internal surface 90. As will be discussed with respect to FIG. 12 this prism arrangement is, in large part, responsible for the smoothing out of light between light segments B1′ and B2′ so as ultimately to provide segment D′.

Prism arrangement 108 includes a first group of prisms 108A which extend parallel with the major axis 84 of the refractor a substantial distance along bottom surface 90 on opposite sides of axis 84. As indicated in FIGS. 9 and 10, these prisms tend to bend the light impinging thereon from reflector 34 and light source 36 in the directions indicated by arrows A, i.e., to widen the light lengthwise of the roadway when the luminaire is in its operating position. The prism arrangement also includes a group of prisms 108B located on one side of parallel prisms 108A and second group 108C located on the opposite side of prisms 108A. Each of these latter groups 108B and 108C includes prisms, both continuous curved and straight prisms, which together form a somewhat concave pattern radiating from prisms 108A partially up internal side surfaces 94 and 98. In this manner, light impinging on prisms 108B and 108C is redirected in directions toward the four corners of the refractor, as indicated by arrows B and C, i.e., lengthwise of the roadway but angled towards the far and near curbs thereof.

Figure 12:
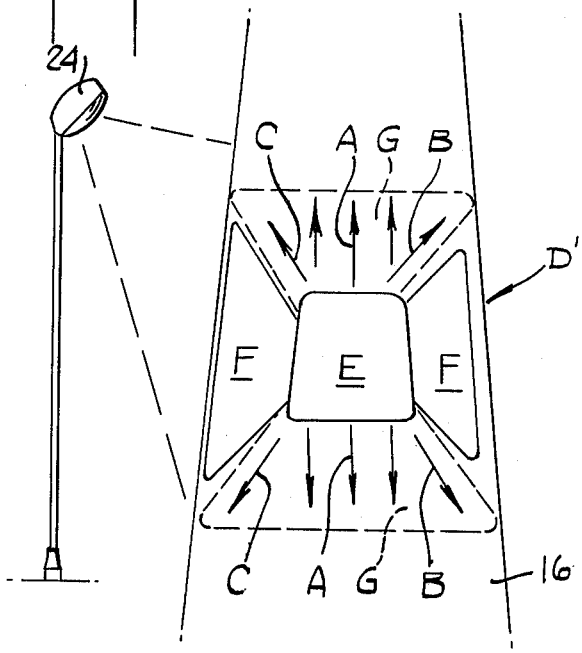
FIG. 12 is a schematic illustration showing the manner in which the refractor of FIGS. 8–11 acts on the light from the luminaire of FIG. 3 to more uniformly spread the light along the roadway.

FIG. 12 illustrates schematically the light placement on roadway 16 resulting from prism arrangement 108. Without these prisms, luminaire 24 produces a fairly bright somewhat rectangular segment of light E (indicated by solid lines) directly in front of the luminaire. The luminaire (without the prisms) also produces substantially less bright segments F (also solid lines) which are located on the street and house sides of segment F and which more or less take the form of "butterfly wings." Prism arrangement 108 does little if anything to segments F. Instead, this arrangement acts upon the light otherwise producing segment E so as to spread this segment lengthwise of the street in a butterfly fashion as indicated by dotted lined segments G in FIG. 12, the arrows A, B and C corresponding to arrows A, B and C in FIG. 9 illustrating how this takes place. As a result of this spreading action, the brightness level of combined segments E and G is approximately equal to that of segments F, thereby producing substantially uniform overall segment D′.

One point which should be noted is that luminaire 24, in its operating position, tends to throw the light closer to the house side of roadway 16 than the street side, particularly directly in front of the luminaire. To compensate for this refractor 80 includes a group of prisms 110 located on the bottom external surface 88 of the refractor. As illustrated in FIGS. 8 and 11, these prisms extend parallel with minor axis 86 and are positioned adjacent one another to form a band extending along major axis 84 centrally between the street and house ends of the refractor. As best seen in FIG. 11, the prisms 110 are angled so as to bend the light passing therethrough from the light source in a direction toward the far roadway curb, i.e., across the street. In this way the light on the roadway directly in front of the luminaire is more uniformly spaced between the curbs.

As indicated in FIG. 11, reflector 34, when positioned behind the refractor, has its top and bottom edges actually extending within the refractor. To hide or obscure these edges, which is desirable, refractor 80 includes obscuration prisms 112 located on the internal top and bottom surfaces 102 and 106. These prisms prevent clear viewing of the reflector edges.

Luminaire 24 has been illustrated and described without some conventional components being shown. For example, although not shown, conventional means for supporting the reflector to a reflector housing (not shown) could be readily provided. In the same manner, means for supporting the light source in the position shown has not been illustrated but could readily be provided and means for supporting the refractor to the reflector could also be readily provided. A ballast (not shown), if necessary, could be readily provided.

What we claim is:

1. An arrangement for lighting a straight section of a roadway having spaced-apart parallel curbs, comprising:

(a) a luminaire including (i) a reflector having first and second side-by-side light-reflective surfaces, each of which is defined by a segment of a paraboloid of revolution, said surfaces having a common focal point located on the intersecting line of two intersecting planes which are normal to one another and respective first and second parabolic axes, said first axis lying on a first one of said planes and extending forwardly of and past said second surface at an acute angle with said second plane and said second axis lying on said first plane and extending past said first surface at an acute angle with said second plane, (ii) means for supporting said reflector, (iii) a linear light source positioned to extend substantially along the intersection of said two planes and through said focal point, (iv) means for supporting said light source, and (v) means for refracting light directly from said source and light reflected from said reflective surfaces; and (b) means for supporting said luminaire in a position above and a substantial distance to one side of the curbs of said roadway such that said first plane, if extended, would intersect said roadway in a direction parallel to said curbs.

2. An arrangement according to claim 1 wherein the angle at which said first plane extends from the vertical is the angular bisector of two lines respectively extending in said second plane from said focal point to said curbs.

3. An arrangement according to claim 1 wherein said acute angles are substantially equal to one another.

4. An arrangement according to claim 3 wherein said acute angle is between approximately 55° and 65°.

5. An arrangement according to claim 4 wherein said acute angle is approximately 60° and wherein said axes are located at angles of approximately 70° with nadir.

6. An arrangement according to claim 1 wherein said first and second light reflective surfaces include a common inner parabolic surface edge having upper and lower ends, said edge lying on said second plane such that said upper and lower ends extend at least to respective upper and lower points on a third plane normal to said first and second planes, said third plane intersecting both of said surfaces along respective first and second parabolic curves which respectively extend substantially continuously from said upper point to said lower point on opposite sides of said second plane.

7. An arrangement according to claim 6 wherein said first and second surfaces include respective first and second outer parabolic surface edges which are substantially equal in length and which respectively comprise segments of said first and second parabolic curves.

8. An arrangement according to claim 7 wherein the upper and lower ends of said inner surface edge extend past said third plane and wherein each of said first and second light reflective surfaces includes upper and lower surface segments located outside of said third plane above and below said outer surface edges, respectively.

9. An arrangement according to claim 8 wherein said first light reflective surface includes upper and lower outer parabolic surface edges which respectively extend outwardly from the ends of said first outer surface edge to the ends of said inner surface edge and wherein said second light reflective surface includes upper and lower outer parabolic surface edges which respectively extend outwardly from the ends of said second outer surface edge to the ends of said inner surface edge.

10. An arrangement according to claim 9 wherein said acute angles are substantially equal.

11. An arrangement according to claim 10 wherein said acute angle is between approximately 55° and 65°.

12. An arrangement according to claim 11 wherein said angle is approximately 60° and wherein said axes are located at angles of approximately 70° with nadir.

13. An arrangement according to claim 12 wherein the angle at which said first plane extends from the vertical is the angular bisector of two lines respectively extending in said second plane from said focal point to said curbs.

14. An arrangement according to claim 1 wherein said refractor includes a bottom surface having a prism arrangement for refracting light from said source and from said reflecting surfaces, said arrangement including;

(a) a first group of substantially straight prisms extending parallel with said second plane, (b) a second group of prisms located on one side of said first group and together forming a concave array radiating outwardly from said first group, and (c) a third group of prisms located on the opposite side of said first group and together forming a concave array radiating outwardly from said first group.

* * * * *